United States Patent [19]

Lee

[11] Patent Number: 4,992,912

[45] Date of Patent: Feb. 12, 1991

[54] MULTIFUNCTIONAL SOUNDING AND LIGHTING DEVICE

[75] Inventor: Yeou-Ching Lee, Taipei, Taiwan

[73] Assignee: Alvin Lee Jewelry, Inc., Taipei, Taiwan

[21] Appl. No.: 398,736

[22] Filed: Aug. 25, 1989

[51] Int. Cl.[5] ..... F21V 9/16

[52] U.S. Cl. ..... 362/86; 362/234; 362/394; 362/800

[58] Field of Search ..... 362/861, 184, 200, 234, 362/253, 394, 800, 806

[56] References Cited

U.S. PATENT DOCUMENTS 4,535,392 8/1985 Montgomery ..... 362/800 X 4,652,980 3/1987 Segan ..... 362/86

*Primary Examiner*—Stephen F. Husar

*Attorney, Agent, or Firm*—Willian Brinks Olds Hofer Gilson & Lione

[57] ABSTRACT

A multifunctional sounding and lighting device includes: a housing unit with an upper case and a lower case which are detachably combined to facilitate the operations of the device; a printed circuit board having sound and light circuits disposed therein fixed on the lower case; a buzzer provided in the upper case and electrically connected to the sound circuit for being activated to produce sound thereat; a plurality of light-emitting elements fixed on the PC board and electrically connected to the light circuit for being energized to emit light thereat; a power supply unit provided in the lower case; a pressure switch coupled between the circuits of the PC board and the power supply unit; an actuating member installed in the housing unit for being operated to turn the pressure switch on and off; and a pair of pressure springs disposed between the upper case and the lower case; whereby, when pressure is applied to either side of the housing unit, the actuating member will turn on the pressure switch to perform sounding and lighting functions thereat.

11 Claims, 3 Drawing Sheets

(A - A')

MULTIFUNCTIONAL SOUNDING AND LIGHTING DEVICE

BACKGROUND OF THE INVENTION

This invention relates to a sounding and lighting device for commercial advertising preparations, and particularly to a type of sounding and lighting device which is compact and simple so as to facilitate the installation thereof and which can perform sounding and lighting operations upon the application of pressure on either side of said device.

At present, many kinds of commercial advertising forms, such as advertising boards, advertising windows, ornamental displays at feasts and celebrations, house decorations, etc., are available at various places. In the case of billboards, for instance, sounding and lighting devices are generally disposed thereon and matched with the advertising contents thereof with the purpose of attracting the attention of passers-by. Known sounding and lighting devices are usually composed of a switch, a buzzer and a light-emitting lamp, which is normally associated with the eyes of the figures in the advertisement, all of these components being separately installed on the advertising board. With the arrangement of these components of a conventional sounding and lighting device, when the switch is turned on, the buzzer will produce sound and various indicators will be lit, animating the associated advertising board so as to draw the attention of passers-by and achieve the desired advertising effect therewith. However, the arrangement of conventional sounding and lighting devices suffer from the following common shortcomings:

(1) In the installation of conventional sounding and lighting devices, complicated operations are necessary in order to individually dispose all of the sounding and lighting elements of said devices at different locations on the advertising board. Thus, more manpower is required, resulting in higher costs.

(2) In order to maintain the aesthetic appearance of the advertising board, the switches of conventional sounding and lighting devices are usually provided at a specific location, such as at a back side of the advertising board, causing a considerable inconvenience in performing switch control operations.

SUMMARY OF THE INVENTION

It is accordingly a primary object of the present invention to provide a multifunctional sounding and lighting device with a compact and integral arrangement of all the components thereof so that said sounding and lighting device can be simply disposed on a related advertising unit and operated by applying pressure either on the advertising unit or on one side of said sounding and lighting device so as to control the sound and light effects therewith.

This and other objects of the present invention are achieved by the provision of a multifunctional sounding and lighting device which comprises: a housing unit composed of an upper case and a lower case, said upper case having an open section formed in one side thereof and a locating slot in a bottom surface of said open section, said lower case having an upper open room formed in one side thereof in conjunction with the open section of said upper case and a concave surface provided in another side thereof, being coupled with said upper case; a circuit means having a printed circuit (PC) board provided with sound and light circuits thereon disposed on the concave surface of said lower case; a sound generating means installed at the locating slot of said upper case and electrically connected to the sound circuit of said circuit means for being actuated to produce sound thereat; a light emitting means disposed on the lower surface of said PC board and electrically connected to the light circuit thereof for being energized to emit light thereat in conjunction with the related light apertures, (such as the eyes of an advertisement figure), of an advertising unit; a switching means installed on a top surface of said PC board and electrically connected to the sound and light circuits thereof for being operated to turn on and off said sound generating and light emitting means; a power supply means provided in the upper open room of said lower case and electrically connected to the sound and light circuits of said circuit means through said switching means; an elastic means installed in said housing unit for providing a biasing action between said upper and lower cases; and an actuating means disposed in said housing unit in conjunction with said switching means to be operated to control said switching means; whereby, the assembled sounding and lighting device of the present invention can be easily installed on an advertising unit and conveniently operated by the application of pressure on either side of said sounding and lighting device so as to produce sound and light effects.

Other advantages and characteristics of the present invention will become apparent from the following detailed description of a preferred embodiment when read in conjunction with the accompanying drawings.

DETAILED DESCRIPTION OF THE PREFERRED EMBODIMENT

Figure 1:
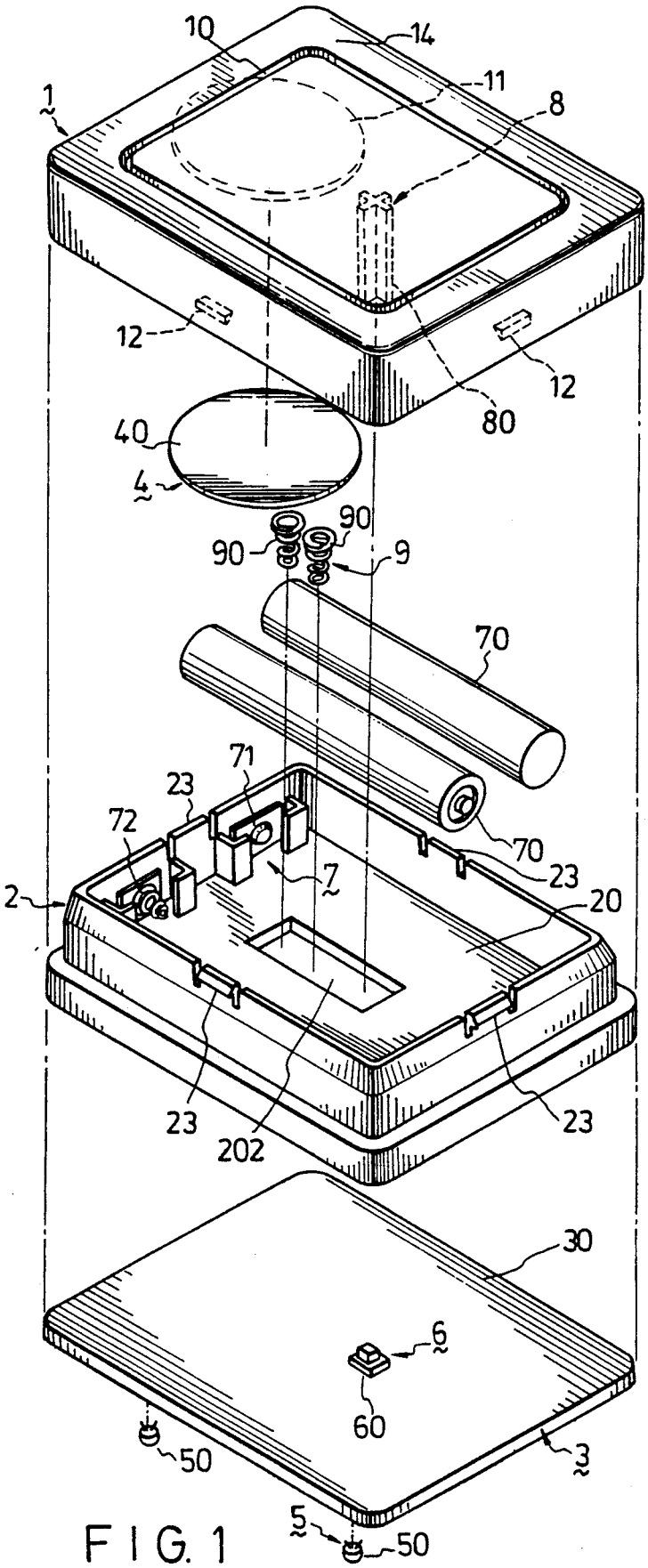
FIG. 1 is an exploded and perspective view of a preferred embodiment of a multifunctional sounding and lighting device according to the present invention.
Figure 2:
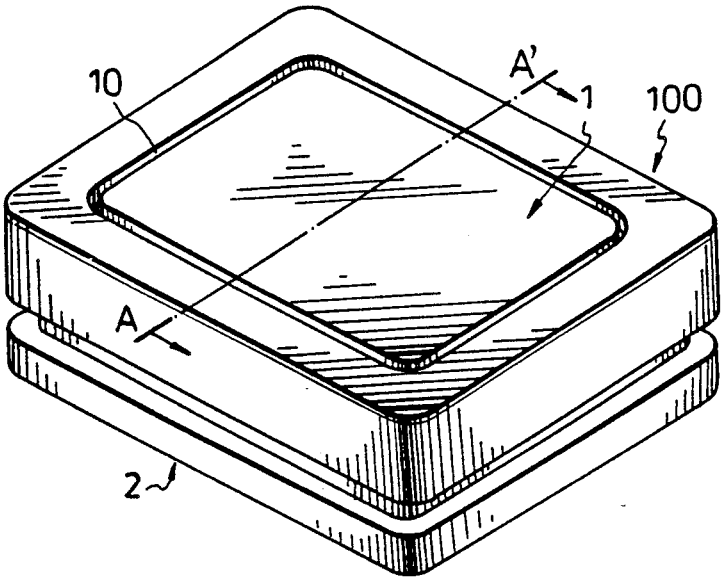
FIG. 2 is a perspective view of the assembled preferred embodiment of FIG. 1.
Figure 3:
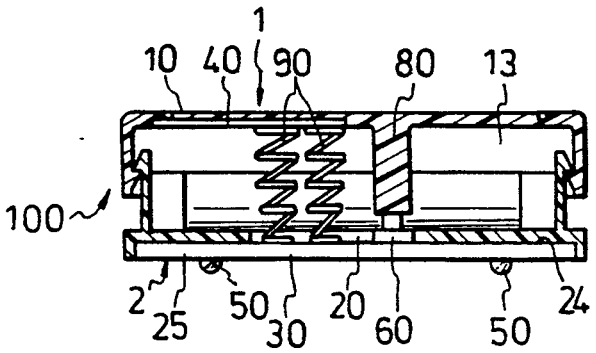
FIG. 3 is a sectional view of the assembled preferred embodiment taken along the line A—A' of FIG. 2.

Referring to FIGS. 1, 2 and 3, the preferred embodiment of a multifunctional sounding and lighting device according to the present invention comprises a housing unit 100 which is composed of an upper case 1, having a lower case 2, a circuit means 3, a sound-generating means 4, a light emitting means 5, a switching means 6, a power supply means 7, an actuating means 8 and an elastic means 9 respectively installed therein for effecting sounding and lighting operations therewith.

The upper case 1, which is adapted to be detachably combined with said lower case 2 as an integral unit, includes: an open section 13 formed in one side thereof; an annular groove 10 serving as a sound track provided in the top surface 14 in communication with said open section 13 for the passing of the sound produced from said sound generating means 4; an upper catch 12 located at the inner wall of each side of said open section 13; and a locating slot 11 provided in the bottom surface of said open section 13 for the fixing of said sound-generating means 4 thereat.

The lower case 2 includes: an upper open room 20 having an inclined round edge 201 formed in conjunction with the open section 13 of said upper case 1; an elongated opening 202 provided in the bottom side of said upper open room 20; a lower catch 23 provided at each side of said inclined round edge 201 in conjunction with the upper catches 12 of said upper case 1 so as to be mutually engaged with each other after said upper case 1 and said lower case 2 are connected together, as shown in FIGS. 2 and 3; and a concave surface 24 located on the bottom side of said lower case 2. (It is to be noted that the upper case 1 and the lower case 2, after being connected together, can be easily disconnected from each other by means of pressing the lower catches 23 inward against the round edge 201 of said lower case 2.)

As shown in FIGS. 1 and 3, the circuit means 3 includes a PC board 30, having the sound and light circuits respectively disposed thereon, fixed on the concave surface 24 of said lower case 2. (It is to be noted that since the sound and light circuits are well known to those skilled in the art, detailed description and illustration thereof are hereby omitted for simplicity.)

The sound-generating means 4 includes a buzzer 40 disposed at the locating slot 11 of said upper case 1 and electrically connected to the sound circuit of said PC board 30 so as to be energized to produce sound thereat.

The light-emitting means 5 is composed of a plurality of light-emitting diodes (LED) 50, which are properly fixed on the bottom surface of said PC board 30 and electrically connected to the light circuit of said PC board 30. (It shall be appreciated that said light-emitting means 5 is preferably disposed in conjunction with the related portions of an advertising arrangement, such as the eyes of the figures in an advertisement.)

The switching means 6 comprises a pressure switch 60 installed on the top surface of said PC board 30 and electrically coupled between the sound and light circuits of said circuit means 3 and the battery-holding seats 71, 72 of said lower case 2 with the contact button of said pressure switch 60 being located in the elongated opening 202 of said lower case 2 so as to be operated by said actuating means 8 to turn on and off said sound and light circuits thereat.

The power supply means 7, as shown in FIG. 1, includes a pair of battery holding seats 71, 72, (the other portions of which hidden on the opposite side of the upper open room 20 of said lower case 2), symmetrically located at the opposing sides of the upper open room 20 of said lower case 2 where a pair of dry batteries 70 are electrically installed so that the required power may be supplied to the device therefrom. Replacement of said batteries can be easily made in said battery holding seats 71, 72 after the upper case 1 is disconnected from the lower case 2.

The actuating means 8 includes a cross-shaped post 80 having one end thereof vertically fixed on the bottom surface of the open section 13 of said upper case 1 and the other end located over the top of the contact button of said pressure switch 60 through the elongated opening 202 of said lower case 2 so that, by applying pressure on either side of said housing unit 100, said actuating means 8 will make contact with said pressure switch 60.

As shown in FIG. 3 with reference to FIG. 1, the elastic means 9 is composed of a pair of pressure springs 90 the upper ends of which are separately engaged with the lower side of said buzzer 40 and the lower ends of which are positioned on the top surface of said PC board 30 so as to maintain a proper biasing action between the upper and lower cases 1, 2. In addition, said pressure springs also serve as electrical conductors between said buzzer 40 and the sound circuit of said PC board 30.

The preferred embodiment is thus assembled as a compact and an integral unit as shown in FIG. 2. When pressure is applied, either on the upper case 1 or on the lower case 2, the lower end of said cross-shaped post 80 will press the contact button 601 of said pressure switch 60 to energize the buzzer 40 and the LED's 50 so that sound and light are produced accordingly, continuing so until pressure is again applied to either side of the preferred embodiment.

Figure 4A:
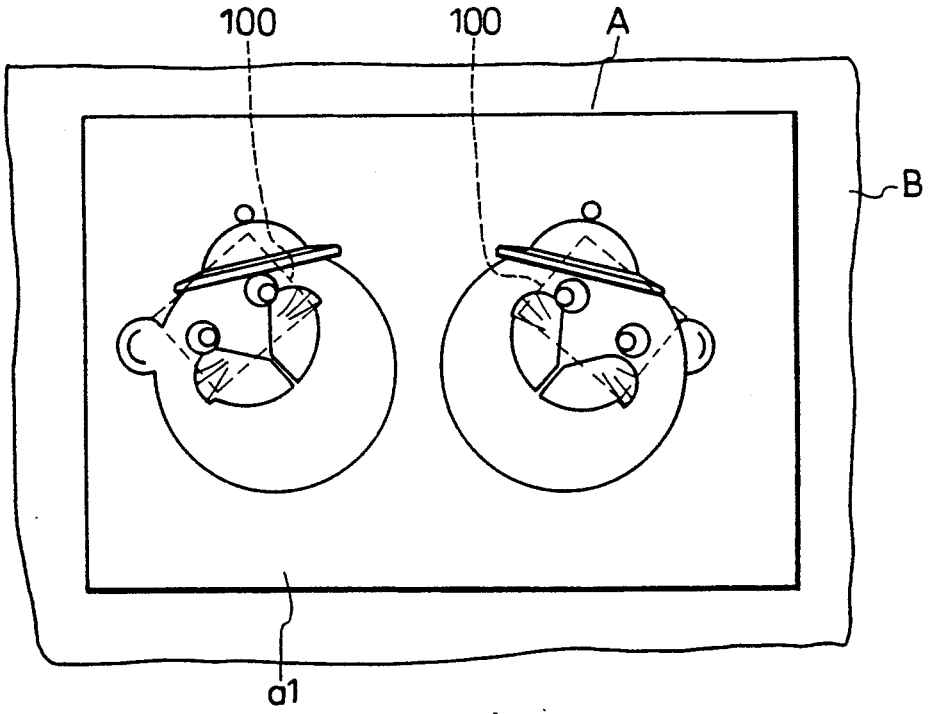
FIGS. 4A and 4B are illustrations indicating the preferred embodiment disposed in conjunction with an advertising arrangement.

Referring to FIG. 4A, as many of the preferred embodiments as required can be used on an advertising board. As shown in FIG. 4A, two multifunctional sounding and lighting devices according to the present invention are arranged on an advertising board A which is fixed on a building wall B. The housing unit 100 of said sounding and lighting devices can be positioned on the back side of said advertising board Al by means of a "velcro" strip or other adhesive material wherein the light emitting means 5 of said sounding and lighting devices are aligned with the eyes of the figures in the advertisement. Whereby, when pressure is applied to the outside surface A1 of said advertising board A, (which is the same as pressure being applied to either side of the housing units 100 of said sounding and lighting devices), sound and light to be associated with the advertisement figures of said advertising board A1 will be produced thereat.

Figure 4B:
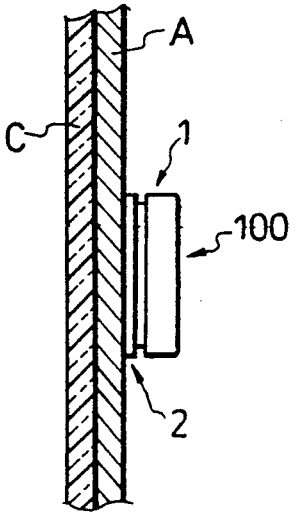

Referring to FIG. 4B, when the advertising board A having a sounding and lighting device arranged thereon, is disposed on a glass window C, by pressing the upper case 1 of said sounding and lighting device, sound and light effect will be produced accordingly. Pressing the upper case 1 again, sound and light effect will be immediately stopped thereat. Therefore, installation and operation of the preferred embodiment of the present invention can be conveniently carried out for all kinds of advertising forms. (It shall be appreciated that various models of the sound-generating means 4 and the light emitting means 5 can be adapted for the preferred embodiment so that different sound and light patterns may be produced for promoting the advertising effect therewith.)

While a preferred embodiment has been illustrated and described, it will be apparent that many changes and modifications may be made in the general construction and arrangement of the present invention without departing from the spirit and scope thereof. It is therefore desired that the present invention be not limited to the exact disclosure but only to the extent of the appended claims.

What is claimed is:

1. A multifunctional sounding and lighting device comprising:

a housing unit composed of an upper case and a lower case, said upper case having an open section formed in one side thereof and a locating slot provided in a bottom surface of said open section, and said lower case having an upper open room with an inclined round edge thereof formed in conjunction with the open section of said upper case and a concave surface provided on a bottom side of said upper open room with an elongated opening located in a middle portion thereof;

a circuit means installed in the concave surface of said lower case for effecting various electrical functions therewith;

a sound-generating means fixed in the locating slot of said upper case and electrically connected to said circuit means for being energized to produce sound thereat;

a light-emitting means installed in said circuit means and electrically connected thereto for being activated to emit light thereat;

a switching means disposed at said circuit means in conjunction with the elongated opening of said lower case and electrically coupled with said sound and light circuits for being actuated to turn on and off said sound-generating means and light emitting means;

a power supply means provided in the upper open room of said lower case and electrically coupled with said circuit means through said switching means for effecting power supply operations thereat;

an actuating means fixed on the bottom surface of the open section of said upper case in conjunction with said switching means for being operated to turn on and off said switching means; and an elastic means installed in said housing unit so as to provide a biasing action between said upper case and said lower cases; whereby, when pressure is applied to either side of said housing unit, said switching means will be operated to turn on and off said circuit means for controlling the operations of said sound generating means and said light emitting means therewith.

2. A multifunctional sounding and lighting device according to claim 1 wherein said circuit means comprises a printed circuit (PC) board having sound and light circuits provided thereon for facilitating convenient installation and electrical operations therewith.

3. A multifunctional sounding and lighting device according to claim 1 wherein said sound generating means comprises a buzzer electrically arranged at the locating slot of said upper case for being energized to produce sound thereat.

4. A multifunctional sounding and lighting device according to claim 1 wherein said lighting means comprises a plurality of light emitting diodes (LED) which are respectively fixed on a bottom side of said PC board and electrically connected to said light circuit thereof so as to be easily energized to emit light thereat.

5. A multifunctional sounding and lighting device according to claim 1 wherein said switching means comprises a pressure switch disposed on a top surface of said PC board with a top contact button of said pressure switch situated in the elongated opening of said lower case in line with said actuating means for effecting on and off operations thereat.

6. A multifunctional sounding and lighting device according to claim 1 wherein said power supply means comprises a pair of battery seats provided in the upper open room of said lower case and electrically coupled with said circuit means through said switching means so as to facilitate the installation and replacement of a pair of dry batteries therein and supply the required power for said device therefrom.

7. A multifunctional sounding and lighting device according to claim 1 wherein said actuating means comprises a cross-shaped post having one end thereof vertically fixed on the bottom surface of the open section of said upper case and another end located over the top contact button of said switching means through the elongated opening of said lower case so as to be moved to contact the top contact button of said switching means when pressure is applied to either said upper case or said lower case.

8. A multifunctional sounding and lighting device according to claim 1 wherein said elastic means comprises a pair of pressure springs of which each upper end is engaged with a lower side of said sound-generating means and each lower end is positioned on a top surface of the PC board of said circuit means so that said pressure springs can maintain a proper biasing action between the upper case and the lower case of said housing unit as well as serve as conductors electrically connected between said sound generating means and said circuit means.

9. A multifunctional sounding and lighting device according to claim 1 wherein said upper case further comprises an annular groove provided in a top surface thereof in conjunction with said sound generating means so as to facilitate the passing of the sound produced by said sound generating means.

10. A multifunctional sounding and lighting device according to claim 1 wherein said upper case further comprises a plurality of upper catches separately provided at an inner wall of the open section for facilitating engagement therewith.

11. A multifunctional sounding and lighting device according to claim 1 wherein said lower case further comprises a plurality of lower catches formed in conjunction with the upper catches of said upper case and respectively located at an outside wall of the upper open room of said lower case so that said upper case can be movably engaged with said lower case through said upper and lower catches.

* * * * *